United States Patent [19]

Parlin et al.

[11] 4,165,547

[45] Aug. 28, 1979

[54] VACUUM ASSISTED TUFT DYE PRINTING PROCESS

[75] Inventors: David B. Parlin; Helmuth Vits, both of Greenville, S.C.

[73] Assignee: Bigelow-Sanford, Inc., Greenville, S.C.

[21] Appl. No.: 917,414

[22] Filed: Jun. 21, 1978

[51] Int. Cl.[2] ..... D06B 1/00

[52] U.S. Cl. ..... 8/148; 8/149.1; 8/151; 68/5 D; 68/20; 68/200; 68/211

[58] Field of Search ..... 8/148, 149, 149.1, 150, 8/151; 68/5 D, 13 R, 20, 157, 170, 175, 199, 200, 211; 26/2 R; 28/160, 169; 101/115, 126

[56] References Cited

U.S. PATENT DOCUMENTS

| | | | |
|---|---|---|---|
| 2,816,811 | 12/1957 | Tillett et al. | 8/148 |
| 2,984,540 | 5/1961 | Tillett et al. | 8/148 |
| 3,129,442 | 4/1964 | Leckie | 8/149.1 |
| 3,175,488 | 3/1965 | Tillett et al. | 8/148 X |
| 3,434,793 | 3/1969 | Pratt | 8/148 X |
| 3,848,528 | 11/1974 | Seedorf | 101/126 X |
| 4,031,280 | 6/1977 | Weller et al. | 8/148 X |

FOREIGN PATENT DOCUMENTS

| | | | |
|---|---|---|---|
| 2332153 | 1/1975 | Fed. Rep. of Germany | 101/118 |

*Primary Examiner*—Philip R. Coe

*Attorney, Agent, or Firm*—Burgess, Ryan and Wayne

[57] ABSTRACT

An improved process for dyeing carpet by intermittently moving the carpet along a path having horizontal and vertical portions. The horizontal portion of the path is immersed in a print form having compartments separated by thin walls and filled with liquid dyes of varying colors, to impart a desired pattern to the fabric. After the horizontal portion of the fabric is withdrawn from the print form, the fabric is moved along its path so that the immersed portion is moved along the vertical portion of the path. A vacuum slot along the vertical portion of the path adjacent the horizontal portion is activated only while the carpet is in motion, and serves to draw the dye toward the backing of the carpet while removing excess dye therefrom. Thereafter the carpet is steamed to set the dyes.

6 Claims, 1 Drawing Figure

VACUUM ASSISTED TUFT DYE PRINTING PROCESS

Figure 1:
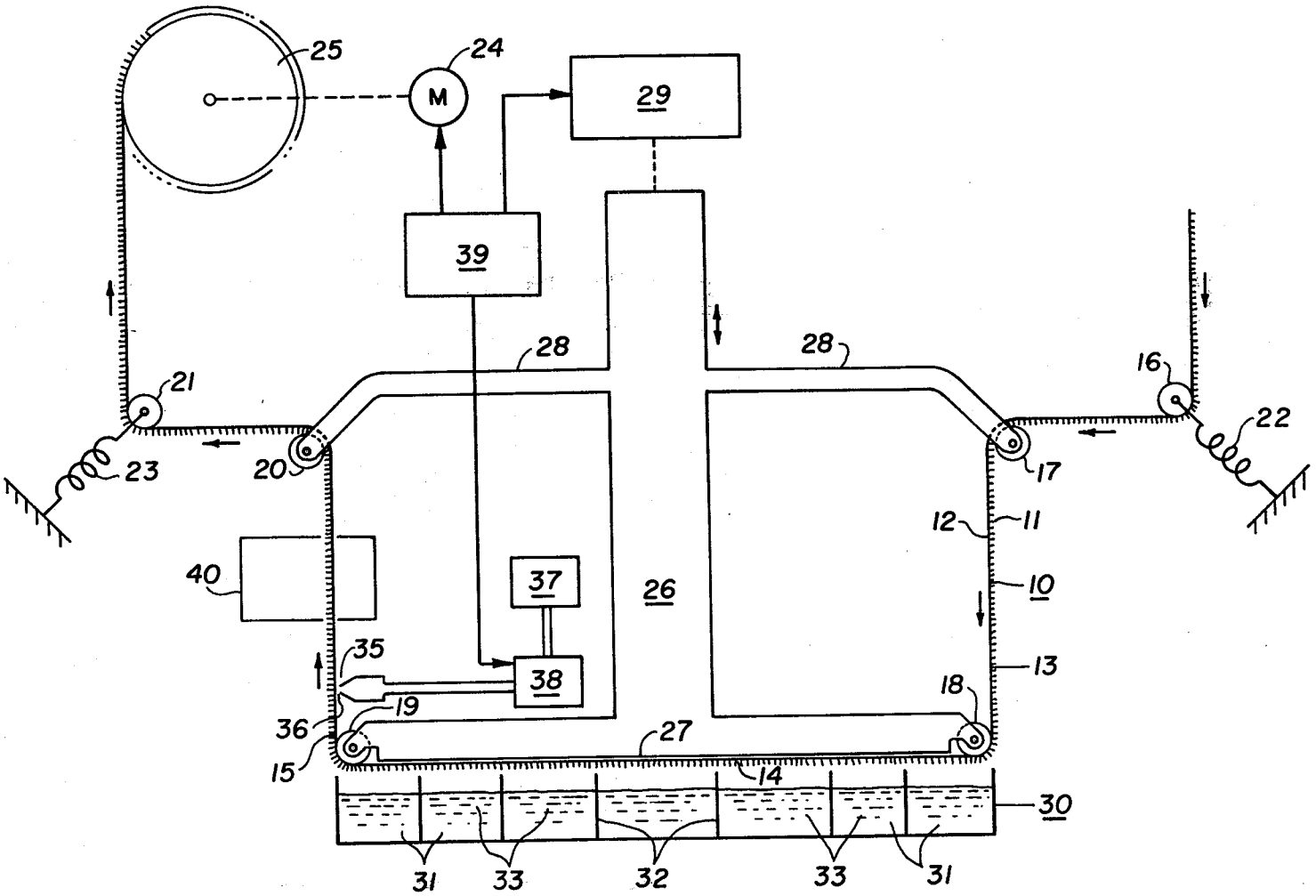

This invention relates to an improved process for dyeing a tufted or pile fabric, of the type employing vacuum to assist in dye penetration and removal of excess dye.

This invention relates to an improvement of the so-called "tuft dye" process for dyeing a tufted fabric, in which a print form is utilized having a plurality of compartments separated by thin walls. Each compartment is provided with a desired size and shape and filled with a liquid dye of a desired color, so that when the tuft portion of a tufted fabric is immersed in the print form, the tufts are dyed in accordance with the print pattern defined by the form. This process is well-known in the art, and is exemplified by U.S. Pat. Nos. 2,816,811, 2,984,540, 3,175,488 and 4,031,280, all of which are hereby incorporated into this application by reference.

Also known is the general concept of using vacuum assistance in conjunction with the dyeing of pile fabrics, for the purpose of improving penetration of the dye and minimizing lateral spreading thereof. For example, U.S. Pat. No. 3,129,442 to Leckie teaches the application of the vacuum assistance technique to a process in which the tufted fabric is intermittently moved, with suction being applied only while printing of the fabric is taking place, and the suction being shut off between printing operations. This reference also discloses the idea of varying the vacuum level of the applied suction to compensate for variation in the dye and pile characteristics.

Also of interest is British Pat. No. 815,704, which discloses a rotary printing arrangement in which suction is applied after the printing step.

An object of the present invention is to provide an improved vacuum assisted process for dyeing a tufted fabric web, utilizing the "tuft dye" method.

As herein described there is provided a process for dyeing a pile fabric having a backing web, comprising the steps of: moving said fabric in a repetitive stepwise manner in a longitudinal direction along a path having a horizontal portion and an upwardly oriented portion, said backing web being disposed above the pile portion of said fabric along said horizontal portion of said path; displacing said horizontal portion of said fabric path downward to immerse the pile portion of said fabric in a print form comprising a plurality of open compartments separated by thin vertical walls and containing dyes of varying colors defining a print pattern, to dye said fabric in accordance with said pattern; thereafter displacing said horizontal portion of said fabric path upward to withdraw said fabric from said print form; thereafter moving said fabric a predetermined distance along said path and then temporarily halting the movement thereof; intermittently applying suction to the backing of said fabric in a zone of predetermined width along said path, said zone being disposed along the upwardly oriented portion of said path adjacent the horizontal portion thereof, said suction being applied only during said fabric moving step, to draw dye toward said backing and remove excess dye from said fabric; and thereafter causing said dye to set in said fabric.

The drawing illustrates a preferred embodiment of the process of the invention.

As shown in the drawing, a tufted pile fabric, i.e. carpeting 10, having a tufted or pile portion 11 and a backing 12, is moved along a path having a downwardly oriented portion 13, a horizontal portion 14, and a vertically oriented portion 15.

The carpet 10 is guided along its path by rollers 16 to 21, with rollers 16 and 21 being tensioned by springs 22 and 23, respectively to maintain the carpet taut. A motor 24 drives a take-up drum 25 to draw the carpet 10 along its path.

The rollers 18 and 19 are vertically movable and are attached to a vertically movable piston member 26, which has a flat end plate portion 27 abutting and supporting the backing 12 adjacent the horizontal portion 14 of the carpet path. The piston member 26 also has arms 28 which support the vertically movable rollers 17 and 20. A hydraulic cylinder mechanism 29 provides controlled bi-directional vertical movement of the piston member 26.

Disposed adjacent the horizontal portion 14 of the carpet path is a print form 30 comprising a series of compartments 31 separated by thin vertical walls 32 and filled with liquid dyes 33 of varying colors. The compartments 31 are arranged to have sizes and shapes in accordance with a desired print pattern, and the colors of the dyes 33 are also selected in accordance with said pattern. Means well-known in the art (not shown) is provided to maintain the height of the liquid dye 33 at a desired level in each of the compartments 31.

A vacuum chamber 35 is disposed in abutment with the backing 12 of the carpet 10 in the vertical portion 15 of the path of carpet movement, at a point adjacent the horizontal portion 14 of the carpet path. Preferably, the vacuum chamber 35 should be as close to the horizontal portion 14 of the carpet path as possible, with a distance above said horizontal portion of 12 inches or less being preferred.

The vacuum chamber 35 has an open vacuum slot 36 abutting the backing 12, with the width of the slot defining a suction zone. Preferably the suction zone, i.e. the width of the slot 36 in the direction along the vertical portion 15 of the carpet path, should be on the order of the height of the pile of the tufted portion 11 of the carpet 10.

Vacuum is intermittently applied to the chamber 35 and slot 36 by a vacuum source 37 through a vacuum control valve 38.

A control timer 39 controls the sequence and timing of operation of the motor 24, hydraulic cylinder mechanism 29, and vacuum control valve 38. The controller 39 may comprise a solid state programmed timer of conventional construction, or an electromechanical timer comprising a motor driven cam arrangement well-known of the art and of the type, e.g. utilized in various home appliances such as washing machines and dishwashers.

When the dyeing process is initiated, the controller 39 initially causes the hydraulic cylinder mechanism 29 to raise the piston 26, to position the horizontal portion 14 of the carpet 10 above the level of the liquid 33 within the print form 30. At this time the motor 24 is off, and the carpet 10 is not moving along its path.

The controller 39 then actuates the hydraulic cylinder mechanism 29 to cause downward movement of the piston 26, so that the flat plate end portion 27 thereof presses the tufted or pile portion of the fabric 10 into the print form 30, until the backing 11 contacts the upper edges of the print form walls 32. The fabric pile is thus immersed in the print form 30, and the liquid dyes therein impart the desired print pattern to the portion of the carpet disposed along the horizontal part 14 of the carpet path.

Thereafter the controller 39 causes the hydraulic cylinder mechanism 29 to raise the piston 26, to withdraw the portion of the carpet disposed along the horizontal part 14 of its path, from the print form 30.

The controller 39 then actuates the motor 24, and after a short delay to permit the roller 25 to begin moving, the controller 39 also actuates the vacuum control valve 38 to couple vacuum from the vacuum source 37 to the vacuum chamber 35 and slot 36 thereof.

The actuation of the motor 24 causes the carpet 10 to move along its path and be wound upon the drum 25, with the vacuum slot 36 applying suction to the backing 12 of the carpet only while it is in motion.

The controller 39 is programmed to actuate the motor 24 for a time sufficient to move the carpet 10 a distance substantially equal to the width of the horizontal portion 14 of the path thereof. After the carpet has moved such as distance, the controller 39 shuts off the vacuum valve 38, and shortly thereafter shuts down the motor 24. This sequence places a "new" section of carpet to be dyed, along the horizontal path portion 14 adjacent the print form 30, and also ensures that the carpet is in motion at all times that suction is applied thereto via the slot 36.

Setting of the dye in the pile of the carpet 10 is accomplished by heat provided by passing the carpet through a steam chamber 40.

Preferably, the suction applied by the chamber 35 and slot 36 should be at a vacuum level in the range of 0.5 to 2 inches of mercury.

It has been found that a high quality printed carpet is produced by the aforementioned process, due in part to the positioning of the vacuum slot 36 along the vertical portion of the web path adjacent the horizontal portion 14 thereof, and by controlling the valve 38 so that suction is applied only when the carpet is in motion.

The optimum vacuum setting must be determined for each particular combination of carpet and dye, and will be affected by dye viscosity, pile density, pile fiber type, backing composition, and pile height.

The technique herein described is useful for pile fabrics with pile heights ranging from 1/16 to about 1½ inches, and provides good results over a wide range of pile densities.

The process described above is intermittent and repetitive. After the carpet has been stepped, or moved to provide a new or undyed portion adjacent the print form 30, and brought to a halt, the process is simply repeated again.

What is claimed is:

1. A process for dyeing a pile fabric having a backing web, comprising the steps of:

moving said fabric in a repetitive stepwise manner in a longitudinal direction along a path having a horizontal portion and an upwardly oriented portion, said backing web being disposed above the pile portion of said fabric along said horizontal portion of said path;

displacing said horizontal portion of said fabric path downward to immerse the pile portion of said fabric in a print form comprising a plurality of open compartments separated by thin vertical walls and containing dyes of varying colors defining a print pattern, to dye said fabric in accordance with said pattern;

thereafter displacing said horizontal portion of said fabric path upward to withdraw said fabric from said print form;

thereafter moving said fabric a predetermined distance along said path and then temporarily halting the movement thereof;

intermittently applying suction to the backing of said fabric in a zone of predetermined width along said path, said zone being disposed along the upwardly oriented portion of said path adjacent the horizontal portion thereof, said suction being applied only during said fabric moving step, to draw dye toward said backing and remove excess dye from said fabric; and thereafter causing said dye to set in said fabric.

2. The process according to claim 1, wherein said moving step comprises moving said fabric a distance substantially equal to the length of the previously immersed portion of said fabric along said path.

3. The process according to claim 1, wherein said suction is applied at a vacuum in the range of 0.5 to 2.0 inches of mercury.

4. The process according to claim 1, 2 or 3, wherein the vacuum level of said suction is adjustable.

5. The process according to claim 1, 2 or 3, wherein the width of said suction zone is on the order of the height of the pile of said fabric.

6. Apparatus for dyeing a pile fabric having a backing web comprising:

means for moving said fabric in a repetitive stepwise manner in a longitudinal direction along a path having a horizontal portion and an upwardly oriented portion;

means for disposing said backing web above the pile portion of said fabric along said horizontal portion of said path;

a print form comprising a plurality of open compartments separated by thin vertical walls and containing dyes of varying colors defining a print pattern;

means for displacing said horizontal portion of said fabric path downward to immerse the pile portion of said fabric in said print form, to dye said fabric in accordance with said pattern;

means for displacing said horizontal portion of said fabric path upward to withdraw said fabric from said print form;

means for moving said fabric a predetermined distance along said path and for then temporarily halting the movement thereof;

means for intermittently applying suction to the backing of said fabric in a zone of predetermined width along said path, said zone being disposed along the upwardly oriented portion of said path adjacent the horizontal portion thereof, said means being operative to apply suction to said backing only while said fabric is in motion; and means for causing said dye to set in said fabric.

* * * * *